United States Patent [19]

Cruz

[11] 3,945,747

[45] Mar. 23, 1976

[54] EDGING GUIDE

[76] Inventor: Alcides Cruz, 3630 SW. 87th Court, Miami, Fla. 33165

[22] Filed: Oct. 29, 1974

[21] Appl. No.: 518,401

[52] U.S. Cl. ..... 404/7; 52/596
[51] Int. Cl.[2] ..... E01C 11/22
[58] Field of Search ..... 404/7, 8, 6; 52/608, 596

[56] References Cited

UNITED STATES PATENTS

| | | | |
|---|---|---|---|
| 775,791 | 11/1904 | Austin | 404/7 X |
| 2,078,864 | 4/1937 | Macatee | 404/7 |
| 2,471,226 | 5/1949 | Maccario | 404/7 |
| 2,826,393 | 3/1958 | Miller | 404/7 X |
| 3,052,248 | 9/1962 | Reuter | 404/7 X |
| 3,087,279 | 4/1963 | Thompson | 404/7 X |
| 3,232,187 | 2/1966 | Brigham | 404/7 |
| 3,495,352 | 2/1970 | Sbare | 404/7 X |
| 3,636,829 | 1/1972 | Palmer | 404/7 |

*Primary Examiner*—Nile C. Byers

[57] ABSTRACT

An edging guide for use along a fence or building to provide a surface over which one wheel of a lawn mower may roll which guide is composed of a plurality of end-to-end abutting slabs having an upper surface which includes a first portion and an outwardly and downwardly curved portion which curves to the level of the turf above the earth to which a lawn is to be maintained and over which the lawn mower wheel rolls.

6 Claims, 6 Drawing Figures

EDGING GUIDE

FIELD OF THE INVENTION

This invention relates to garden and lawn care implements and, more particularly, to an elongate slab which is adapted to be connected together with a plurality of similar slabs along a building or fence to provide a lawn border so that the lawn may be easily mowed without the need for handwork along the edges, as at fences and along buildings.

BACKGROUND OF THE INVENTION

In the past, as is perhaps well known, it has been very difficult to mow along the edges of fences and buildings without considerable difficulty and handwork in order to provide a neat appearing lawn. The problem has been that the grass tends to climb up close to a fence or wall where it cannot be easily reached by a lawn mower and hand labor or special tools are required to complete a nice looking job.

In the past there have been numerous devices which have been utilized to prevent the growth of grass along the building or a fence. This invention is an improvement in such devices.

This invention has as an object the provision of an improved edging slab to space a lawn mower from the fence and to restrict growth of grass at hard to reach places, such as along a fence or wall; and it includes a downwardly extending foot to anchor the slab in a predetermined position and an upper surface which is curved outwardly from an upper level to the level of the turf so that a lawn mower wheel may be rolled along the curved surface and a neat appearing job be readily accomplished without the need for time-consuming handwork, the slab preferably being of a color which blends with the lawn.

In accordance with these and other objects which will become apparent hereinafter the instant invention will now be described with reference to the accompanying drawings in which:

DETAILED DESCRIPTION OF THE PREFERRED EMBODIMENT

Figure 1:
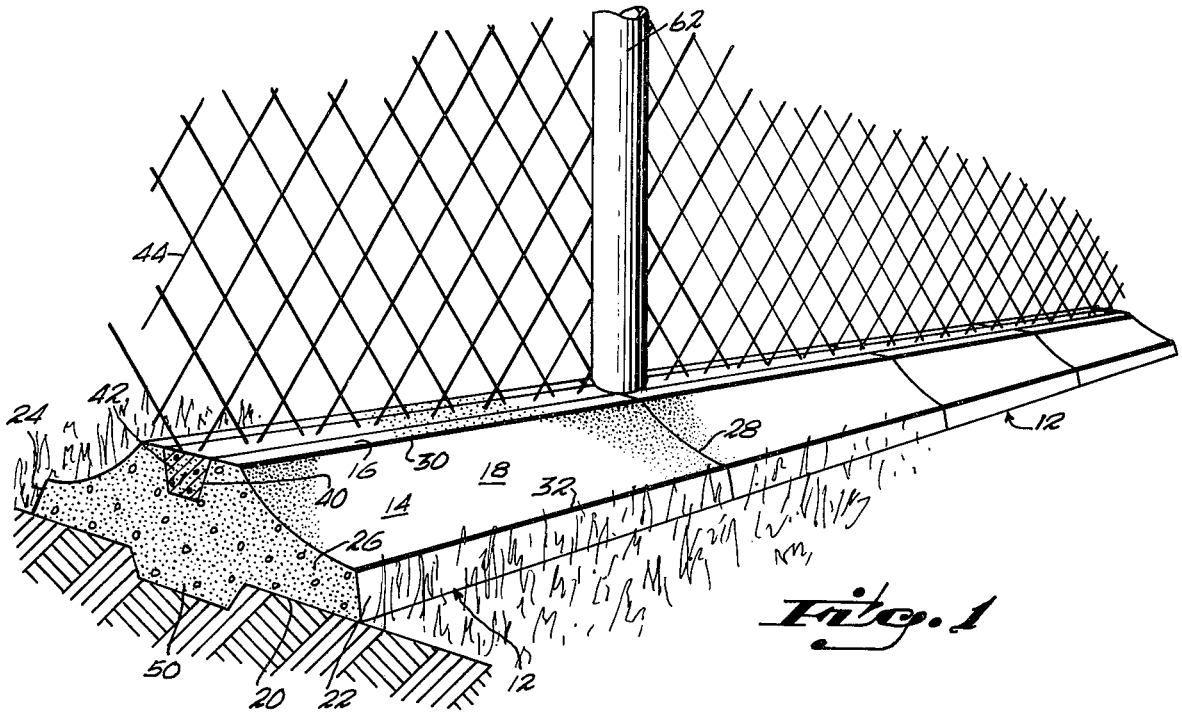
FIG. 1 is a perspective view of the instant invention installed along a fence.

Referring to the drawings it is seen that a slab 12 which is elongate is provided; and that it includes an upper surface generally designated 14 having an upper portion 16 and a lower curved portion 18 and a bottom or lower surface 20, the upper and lower surfaces extending laterally between a first elongate face 22 and a second elongate face 24 between opposite end faces 26 and 28.

Generally, the upper portion of the upper surface extends horizontally to a corner or brink edge 30 and then curves downwardly to a corner or outboard brink edge 32 at the front or first face. When installed, the curved surface provides a riding surface for the wheel of a lawn mower which can then cut grass along a fence or a house.

Figure 2:
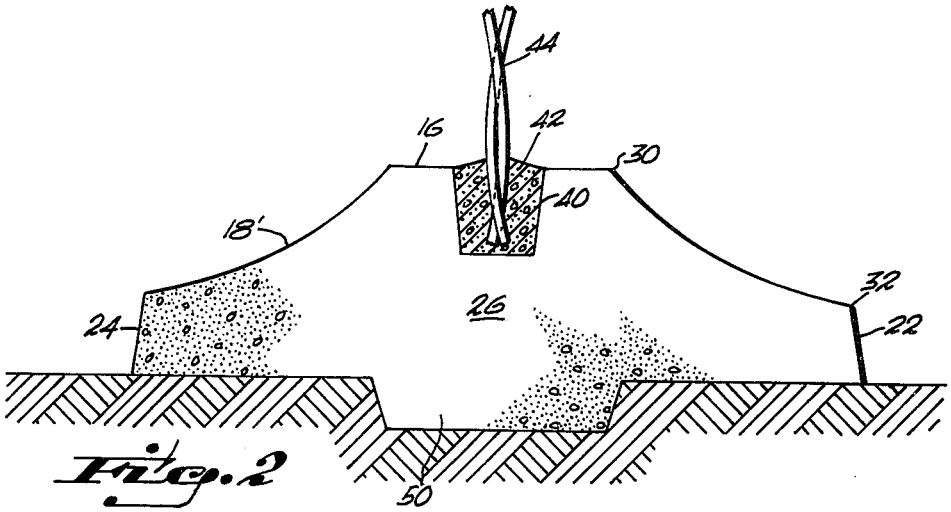
FIG. 2 is a view in cross section of the lower portion of FIG. 1.
Figure 3:
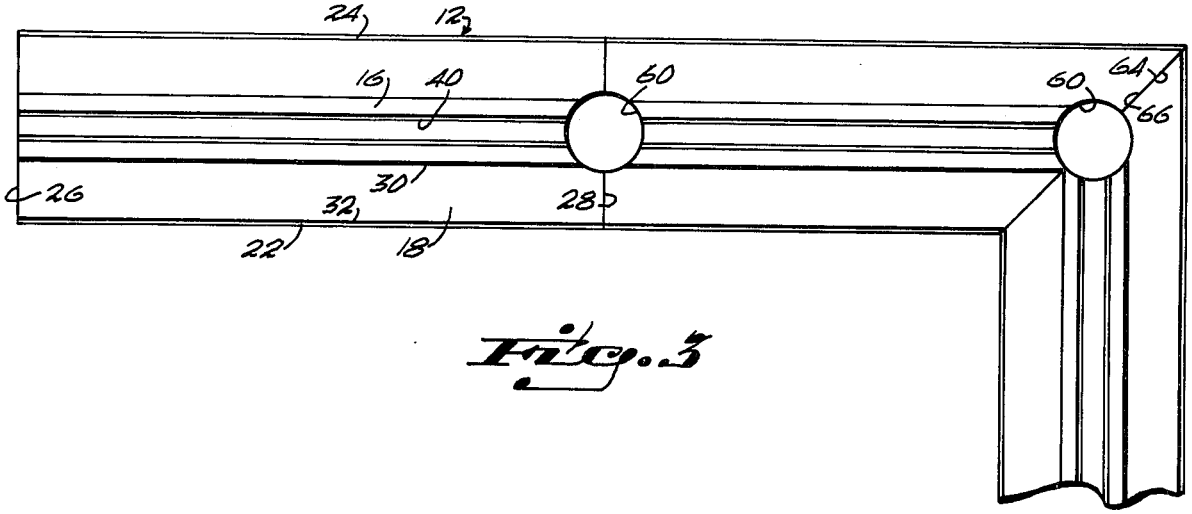
FIG. 3 is a plan view of the fence of FIG. 1 at a corner zone.

Referring to the first preferred embodiment of FIGS. 1 through 3, which is for a fence, it is seen that the upper surface 16 is symmetrically located with respect to a vertical center plane through the slab and that it includes an elongate recess 40 into which a binding material such as 42 may be poured to set and captivate the lower portion of a fence panel 44 as shown in FIG. 2. In this embodiment, the fence embodiment, the top surface includes a second downwardly curved lower portion 18' which extends oppositely to that of the lower portion 18. Also in this embodiment a centrally located and longitudinally extending foot 50 is provided which nests within a slot or channel cut into the earth. As shown in FIG. 3, the end faces may be recessed as at 60 to nest about and embrace a fence post 62 and, also, the end faces may be mitered as at 64 and 66, see FIG. 3, for providing corner joints.

Figure 4:
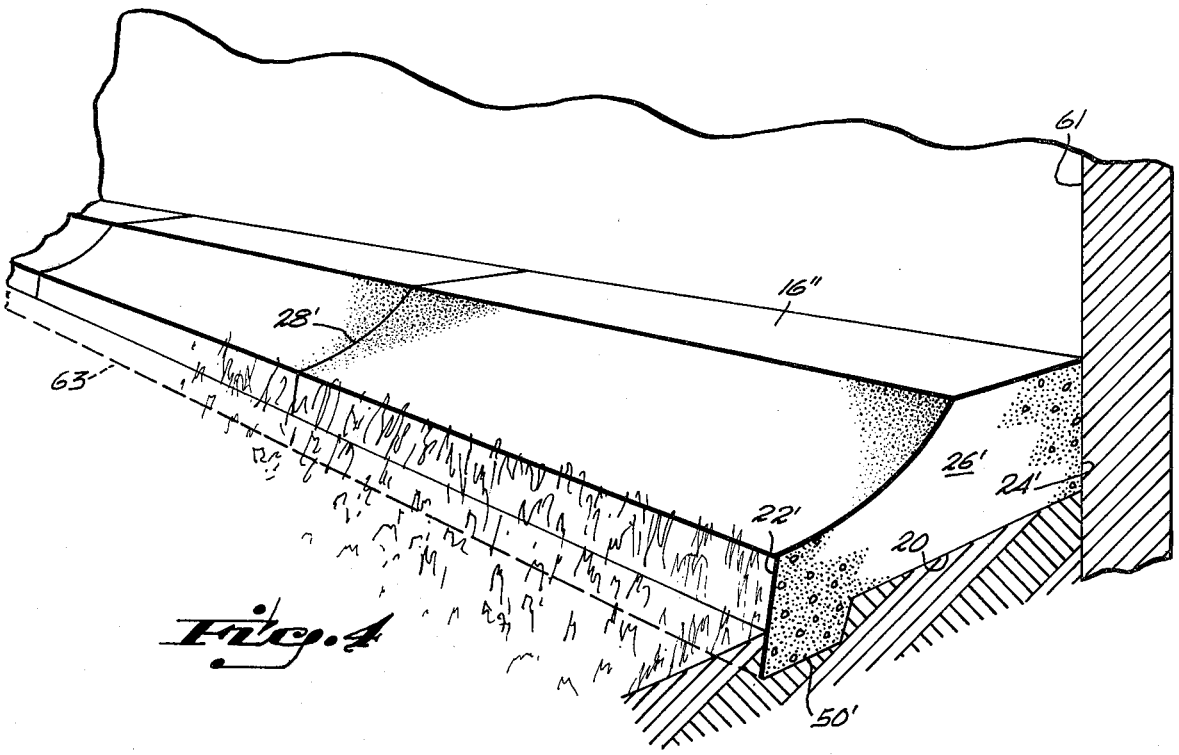
FIG. 4 is a view of the invention installed adjacent a wall.
Figure 5:
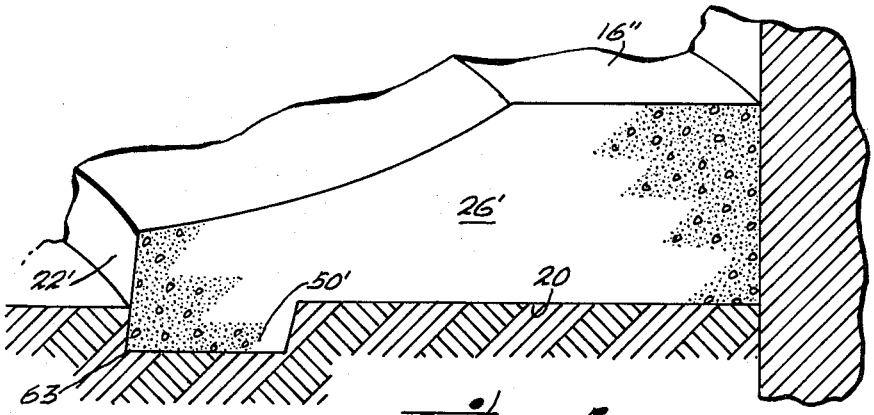
FIG. 5 is a view of the invention installed adjacent a wall and an inside curved surface.
Figure 6:
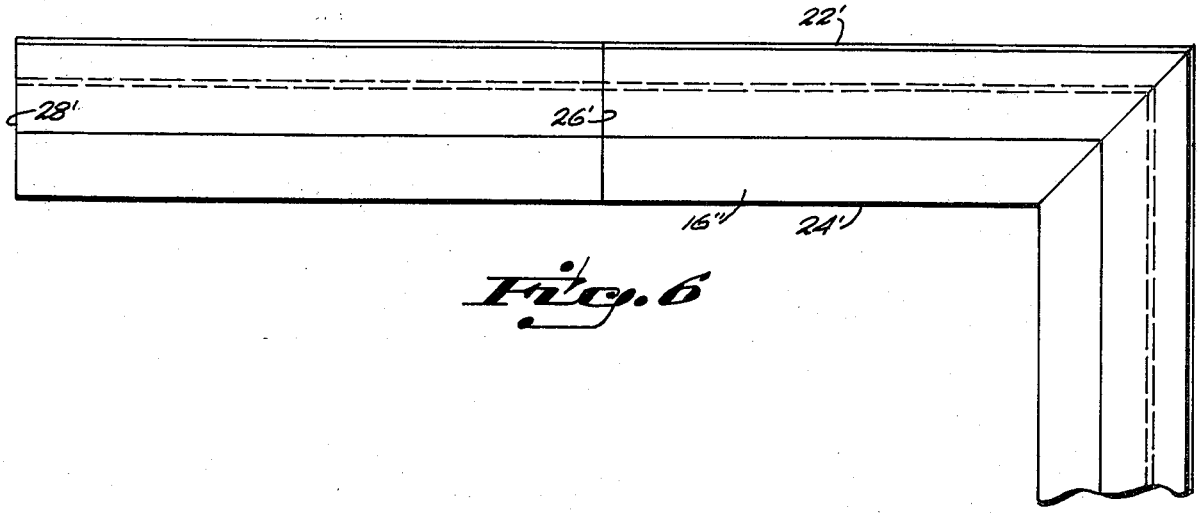
FIG. 6 is a top view of the invention.

Referring to the alternative embodiment shown in FIGS. 4 and 5, the upper surface 16'' similarly extends between end faces 26' and 28'. In this alternative embodiment the top surfaces 16'' extends vertically downwardly forming the second face 24' or a plane of abutment with the building surface 61 and the foot 50' is on the outboard edge of the bottom 20. The ends may be mitered as indicated in FIG. 6 and, preferably, the outboard face or first face 22' is slanted outwardly so as to form a bight edge as at 63 which tends to dig into the earth in response to downward pressures to resist outward movement of the slab from a wall. This slab may also be curved or arcuate as shown in FIG. 5 to meet certain conditions. Also, the mitering of the slab will determine whether it will be an inside corner or an outside corner, that is whether the lawn will be in the crotch defined by the slab or outside as shown in FIG. 6.

What is claimed is:

1. To guide a lawn mower an edging guide element to be positioned at the edge of a lawn comprising a rigid elongate slab having an upper surface, a lower surface to rest on the ground, similarly shaped and sized opposite end surfaces for abutting relation with a similar slab and a first and a second elongate face extending between the upper surface and the lower surface and end surfaces, said upper surface having a first upper portion extending between the end surfaces at a common predetermined height above the lower surface and a curved portion extending between the end surfaces and extending outwardly away from said upper portion and downwardly from said upper portion to said first face in a fair curve as seen in cross section defining a longitudinally extending edge at the juncture of the first face and said curved portion, said edge being at a common predetermined heighth above said lower surface to rest on the ground and defining a trimmed lawn height, said curved portion comprising a track for a lawn mower wheel.

2. The slab as set forth in claim 1 wherein a curved portion is provided curving outwardly and downwardly in a fair curve as seen in cross section away from said upper portion to said second face defining a longitudinally extending edge at the juncture of the second face and the curved portion, and said curved portions being symmetrical with respect to a vertical plane through a longitudinal centerline of the slab.

3. The slab as set forth in claim 2 wherein a longitudinally extending elongate recess is provided in said upper portion between the end surfaces in symmetrical relation with respect to a longitudinally extending vertical center plane through said element, said recess being adapted to receive the lower end margin of a fence panel.

4. The slab as set forth in claim 1 wherein a downwardly extending foot is provided on said lower surface and said foot extends longitudinally beneath said lower surface and said foot includes spaced longitudinally extending surfaces between the end surfaces to engage the ground to resist movement of the element.

5. The device as set forth in claim 1 wherein one of said end faces is mitered for connection to form a corner joint with a similarly mitered elongate slab.

6. The device as set forth in claim 1 wherein said slab is of preformed concrete material.

* * * * *